US012480704B2

(12) United States Patent
Kwon et al.

(10) Patent No.: US 12,480,704 B2
(45) Date of Patent: Nov. 25, 2025

(54) REFRIGERATOR

(71) Applicant: SAMSUNG ELECTRONICS CO., LTD., Suwon-si (KR)

(72) Inventors: Juno Kwon, Suwon-si (KR); Dongho Lee, Suwon-si (KR); Gahyeong Kim, Suwon-si (KR); Jin Jeong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 352 days.

(21) Appl. No.: 18/118,864

(22) Filed: Mar. 8, 2023

(65) Prior Publication Data

US 2023/0332823 A1 Oct. 19, 2023

Related U.S. Application Data

(63) Continuation of application No. PCT/KR2023/003088, filed on Mar. 7, 2023.

(30) Foreign Application Priority Data

Apr. 13, 2022 (KR) ..... 10-2022-0045433

(51) Int. Cl.
*F25D 23/02* (2006.01)
*F25D 23/04* (2006.01)

(52) U.S. Cl.
CPC ..... *F25D 23/028* (2013.01); *F25D 23/025* (2013.01); *F25D 23/04* (2013.01); *F25D 2323/023* (2013.01); *F25D 2323/122* (2013.01)

(58) Field of Classification Search
CPC ..... F25D 23/028; F25D 23/025; F25D 23/04; F25D 2323/023; F25D 2323/122
See application file for complete search history.

(56) References Cited

U.S. PATENT DOCUMENTS 8,945,374 B2 2/2015 Chase
10,006,691 B2 6/2018 Jung
(Continued)

FOREIGN PATENT DOCUMENTS

EP 2 447 642 A2 5/2012
EP 3 851 777 A1 7/2021
(Continued)

OTHER PUBLICATIONS

International Search Report dated Jul. 3, 2023 for International Application No. PCT/KR2023/003088.
Written Opinion of the International Searching Authority dated Jul. 3, 2023 for International Application No. PCT/KR2023/003088.
Extended European Search Report dated Feb. 25, 2025 for European Application No. 23788469.7.

*Primary Examiner* — Elizabeth J Martin
(74) *Attorney, Agent, or Firm* — STAAS & HALSEY LLP

(57) ABSTRACT

A refrigerator having an inner door including an opening between the front and rear surfaces of the inner door, first and second opening side surfaces, and a dike protruding from the rear surface of the inner door and including first and second dike inner surfaces; an outer door on the front of the inner door to open to access the opening; and a water supply unit including a water supply case, an outlet to supply water to a detachable water bucket when the water bucket is installed in the water supply case, and a water level sensor to detect a water level of the water bucket. The rear surface of the inner door includes a spacing portion between the second dike inner surface and the second opening side surface, and the water supply unit is installed on the dike with a portion positioned behind the spacing portion.

15 Claims, 16 Drawing Sheets

(56) References Cited

U.S. PATENT DOCUMENTS

| | | | | |
|---|---|---|---|---|
| 10,941,973 | B2 | 3/2021 | Kim et al. | |
| 11,215,394 | B2 | 1/2022 | Park et al. | |
| 11,391,505 | B2 | 7/2022 | Yoon et al. | |
| 11,808,513 | B2 | 11/2023 | Yoon et al. | |
| 11,846,464 | B2 | 12/2023 | Kim et al. | |
| 2016/0138855 | A1* | 5/2016 | Choo | E05B 7/00 312/405.1 |
| 2018/0187950 | A1* | 7/2018 | Lv | A47B 95/02 |
| 2019/0337790 | A1 | 11/2019 | Lee | |
| 2020/0191470 | A1 | 6/2020 | Park et al. | |
| 2021/0396459 | A1 | 12/2021 | Kwon et al. | |
| 2022/0275988 | A1 | 9/2022 | Park et al. | |
| 2022/0275994 | A1* | 9/2022 | Kwon | F25D 23/04 |
| 2023/0417475 | A1 | 12/2023 | Lee et al. | |

FOREIGN PATENT DOCUMENTS

| | | | |
|---|---|---|---|
| EP | 3 933 319 | A1 | 1/2022 |
| KR | 10-2017-0124239 | A | 11/2017 |
| KR | 10-2018-0080056 | A | 7/2018 |
| KR | 10-2021-0156195 | A | 12/2021 |
| KR | 10-2022-0122176 | | 9/2022 |
| KR | 10-2567513 | | 8/2023 |
| KR | 10-2567530 | | 8/2023 |
| KR | 10-2023-0149280 | | 10/2023 |
| KR | 10-2004-001019 | | 1/2024 |
| KR | 10-2024-0032782 | | 3/2024 |

* cited by examiner

REFRIGERATOR

BACKGROUND

1. Field

The disclosure relates to a refrigerator, and more particularly, to a refrigerator having a dispenser for supplying water by a control of an operation lever, and an automatic water supply for automatically supplying water to a water bucket in response to the water bucket being installed.

2. Description of the Related Art

A refrigerator is a home appliance that includes a main body having a storage room, and a cool air supply for supplying cool air to the storage room to keep foods fresh.

There is a refrigerator including a dispenser configured to provide water from the outer side of the refrigerator according to a user's operation of controlling an operation lever without opening a door.

The dispenser discharges water while a user is pressing the operation lever. Accordingly, the user has difficulties in receiving a large amount of water at once, and when needing a large amount of water, the user needs to continue to press the operation lever until water is collected in a container.

SUMMARY

Aspects of embodiments of the disclosure will be set forth in part in the description which follows and, in part, will be obvious from the description, or may be learned by practice of the disclosure.

According to an embodiment of the disclosure, a refrigerator may include a main body including a storage room; an inner door provided on a front side of the main body and configured to be rotatable about a rotation axis, the inner door including a front surface of the inner door, a rear surface of the inner door, an opening between the front surface of the inner door and the rear surface of the inner door, and a dike protruding from the rear surface of the inner door; an outer door rotatably provided on a front side of at least one portion of the inner door and configured to open or close the opening; and a water supply unit including a water supply case, a water bucket configured to be detachably installed in the water supply case, an outlet configured to supply water to the water bucket when the water bucket is installed in the water supply case, and a water level sensor configured to detect a water level of the water bucket when the water bucket is installed in the water supply case. The inner door may include opening side surfaces forming the opening and the opening side surfaces include a first opening side surface and a second opening side surface, opposite to the first opening side surface, with the first opening side surface being closer to the rotation axis than the second opening side surface. The dike may include a first dike inner surface extending along a same plane as the first opening side surface and a second dike inner surface, opposite to the first dike inner surface, and spaced from the second opening side surface, with the first dike inner surface being closer to the rotation axis than the second dike inner surface. The rear surface of the inner door may include a spacing portion formed between the second dike inner surface and the second opening side surface. The water supply unit may be installed on the dike such that at least one portion of the water supply unit is positioned behind the spacing portion According to an embodiment of the disclosure, the outer door includes a first outer door side surface, a second outer door side surface, opposite to the first outer door side surface, the first outer door side surface being closer to the rotation axis than the second outer door side surface, and a handle extending inward from the second outer door side surface.

According to an embodiment of the disclosure, a width of the outer door is smaller than a width of the inner door so as to provide access to the handle.

According to an embodiment of the disclosure, the inner door includes a catch, and the outer door includes a latch configured to be movable between a locking position at which the latch is connected with the catch, and an unlock position at which the latch is separated from the catch, and a switching lever provided on the handle and configured to control movement of the latch between the locking position and the unlock position.

According to an embodiment of the disclosure, the outer door includes an outer door gasket provided along an edge of the outer door on a rear surface of the outer door, and configured to seal the opening of the inner door upon closing of the outer door, and the latch is positioned between the second outer door side surface and the outer door gasket.

According to an embodiment of the disclosure, the water supply unit further includes a control valve configured to supply the water to the outlet according to the water level of the water bucket when the water bucket is installed in the water supply case.

According to an embodiment of the disclosure, the control valve includes a valve body, an inlet port protruding from the valve body and configured to be connected with a water supply hose that supplies water from a water source, and an outlet port protruding from the valve body and configured to supply the water to the outlet.

According to an embodiment of the disclosure, the outlet port and the outlet are integrated into one body.

According to an embodiment of the disclosure, the control valve is installed in the water supply case, the outlet port protrudes downward from the valve body toward the water bucket when the water bucket is installed in the water supply case, and the inlet port protrudes in a side direction from the valve body.

According to an embodiment of the disclosure, the water supply case includes a buried space positioned behind the spacing portion, and the inlet port protrudes toward the buried space.

According to an embodiment of the disclosure, the inner door includes a door bead protruding from at least one of the first dike inner surface and the second dike inner surface, and the water supply case includes a bead groove in which the door bead is insertable so as to mount the water supply case on the inner door.

According to an embodiment of the disclosure, the inner door includes a coupling hole formed in at least one of the first opening side surface and the second opening side surface, the water supply case includes a through hole corresponding to the coupling hole, and the refrigerator further includes a coupling member configured to be inserted in the through hole and the coupling hole to secure the water supply case to the inner door.

According to an embodiment of the disclosure, the water supply case includes a main case forming a water bucket installing space in which the water bucket is detachably installable on a front surface of the main case, and forming a valve installing space in which the control valve is installed, on an upper side of the main case; and a case cover coupled to an upper portion of the main case and configured to cover the valve installing space.

According to an embodiment of the disclosure, the water supply unit further includes a dispenser nozzle, and an operation lever configured to be manually controllable to cause water to be supplied through the dispenser nozzle.

According to an embodiment of the disclosure, a water intake space configured to supply the water through the dispenser nozzle is formed on the front surface of the main case, and the water intake space and the water bucket installing space are positioned side by side such that the water bucket installing space is positioned further from the rotation axis than the water intake space.

According to an embodiment of the disclosure, a refrigerator may include a main body including a storage room; an inner door provided on a front side of the main body and configured to be rotatable about a rotation shaft, the inner door including a front surface of the inner door, a rear surface of the inner door, and an opening positioned between the front surface of the inner door and the rear surface of the inner door; an outer door rotatably provided on a front side of at least one portion of the inner door and configured to open or close the opening; a water supply case including a water bucket installing space in which a water bucket is detachably installable; a dispenser including a dispenser nozzle, and an operation lever configured to be manually controllable to cause water to be supplied through the dispenser nozzle; an automatic water supply including an outlet, and a water level sensor configured to detect a water level of the water bucket when the water bucket is installed in the water bucket installing space; and a control valve configured to guide water supplied from a water source to the dispenser and the automatic water supply. The dispenser and the automatic water supply may be provided in the inner door in such a way as to be positioned side by side, and the control valve may be positioned above the water bucket installing space.

According to an embodiment of the disclosure, the control valve includes a valve body, an inlet port configured to be connected with a water supply hose that receives water from a water source, a first outlet port connected with a dispensing hose that supplies the water to the dispenser nozzle, and a second outlet port configured to supply the water to the outlet, wherein the second outlet port protrudes downward from the valve body toward the water bucket installing space.

According to an embodiment of the disclosure, the second outlet port and the outlet are integrated into one body.

According to an embodiment of the disclosure, the outer door includes a first side surface, a second side surface, opposite the first side surface, the first side surface being closer to the rotation shaft than the second side surface, and a handle extending inward from the second side surface.

According to an embodiment of the disclosure, the inlet port and the first outlet port are positioned toward a space formed behind a portion of the inner door, the space corresponding to a location of the handle.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

The embodiments described in the present specification are only the most preferred embodiments of the disclosure but do not represent for the entire technical spirit of the disclosure. Thus, it should be understood that various equivalents or modification examples capable of replacing the embodiments of the disclosure are included in the scope of rights of the disclosure at the time when the present application was filed.

It is to be understood that the singular forms "a," "an," and "the" include plural referents unless the context clearly dictates otherwise. It will be understood that when the terms "includes," "comprises," "including," and/or "comprising," when used in this specification, specify the presence of stated features, figures, steps, operations, components, members, or combinations thereof, but do not preclude the presence or addition of one or more other features, figures, steps, operations, components, members, or combinations thereof.

In the present specification, the ordinal terms "first", "second", etc. are used to distinguish a plurality of components from each other, without representing an arrangement order of the components, a manufacturing order of the components, importance of the components, etc.

Meanwhile, in the following description, the terms "front", "rear", "upper", "lower", "upper end", "lower end", etc. are defined based on the drawings, and the shapes and positions of the components are not limited by the terms.

Throughout the disclosure, the expression "at least one of a, b or c" indicates only a, only b, only c, both a and b, both a and c, both b and c, all of a, b, and c, or variations thereof.

Various embodiments of the disclosure disclose a refrigerator having an automatic water supply configured to, when a water bucket is installed, supply water until a preset amount of water is filled in the water bucket.

Various embodiments of the disclosure disclose a refrigerator capable of reducing outflow of cool air upon an access to an automatic water supply.

Various embodiments of the disclosure disclose a refrigerator having an automatic water supply with improved usability.

Various embodiments of the disclosure disclose a refrigerator including a dispenser for supplying water by a control of an operation lever, and an automatic water supply configured to, when a water bucket is installed, supply water until a preset amount of water is filled in the water bucket.

Hereinafter, embodiments of the disclosure will be described in detail with reference to the accompanying drawings.

Figure 1:
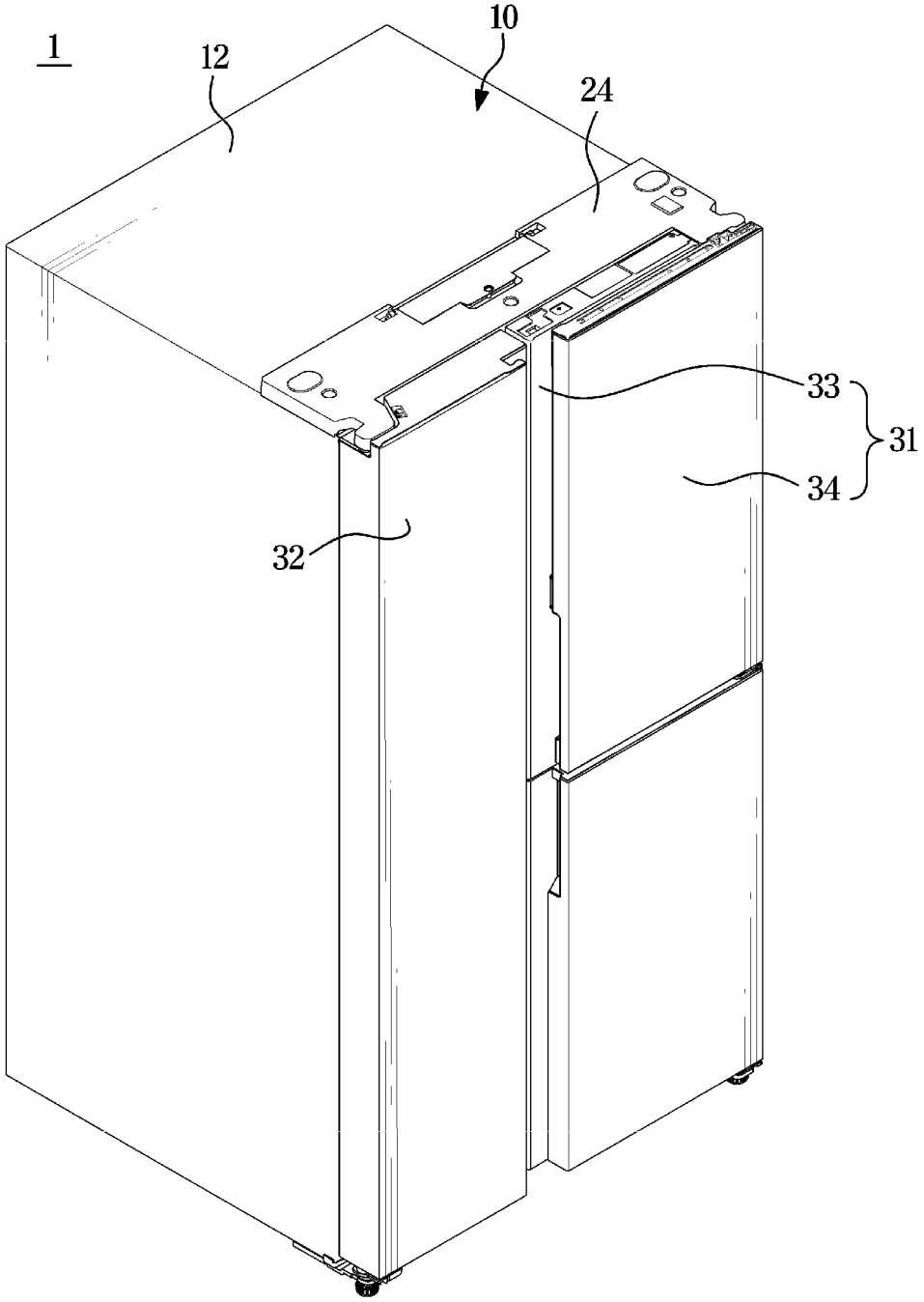
FIG. 1 is a perspective view showing an appearance of a refrigerator according to an embodiment of the disclosure.
Figure 2:
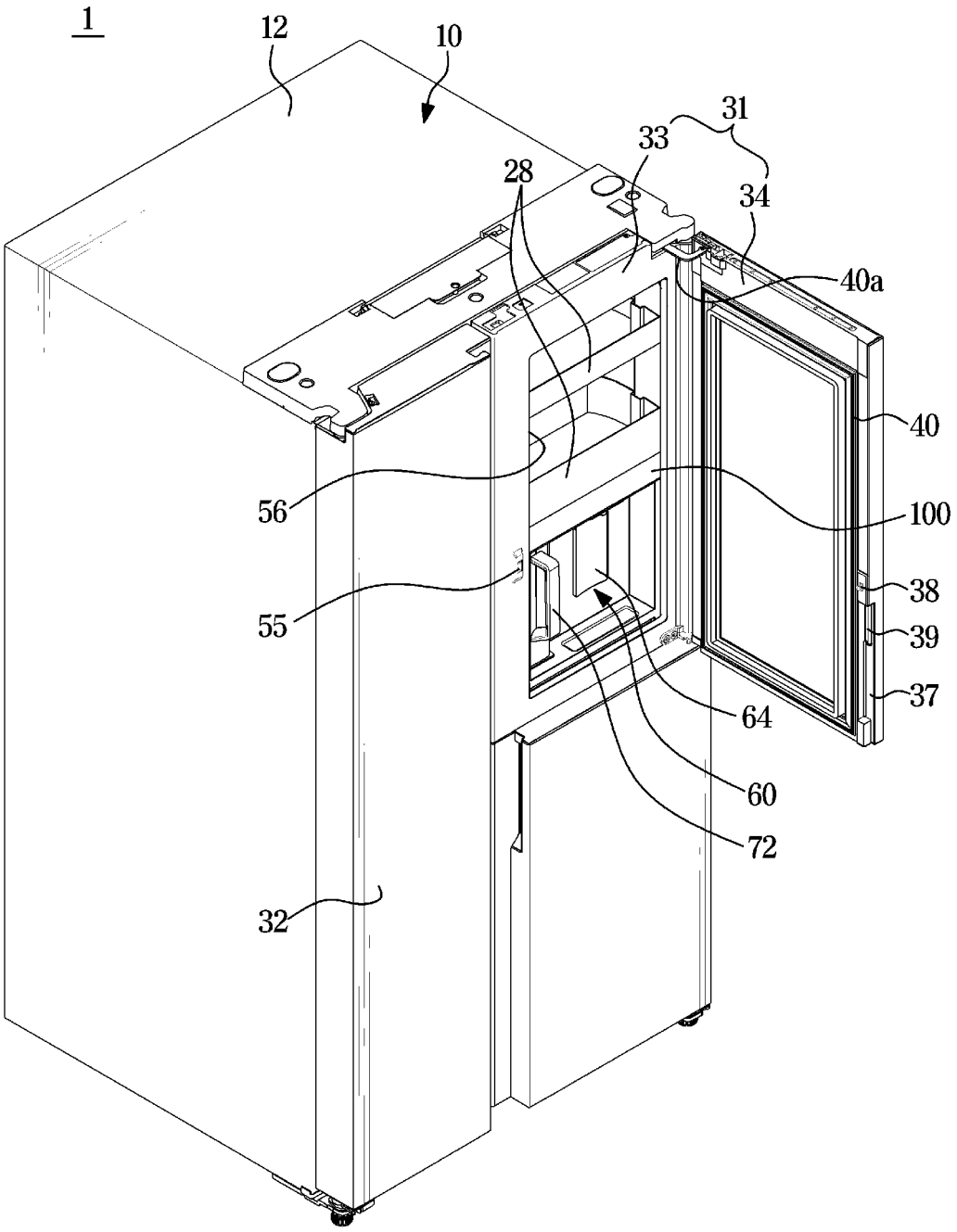
FIG. 2 is a perspective view showing a refrigerator according to an embodiment of the disclosure upon opening of an outer door.
Figure 3:
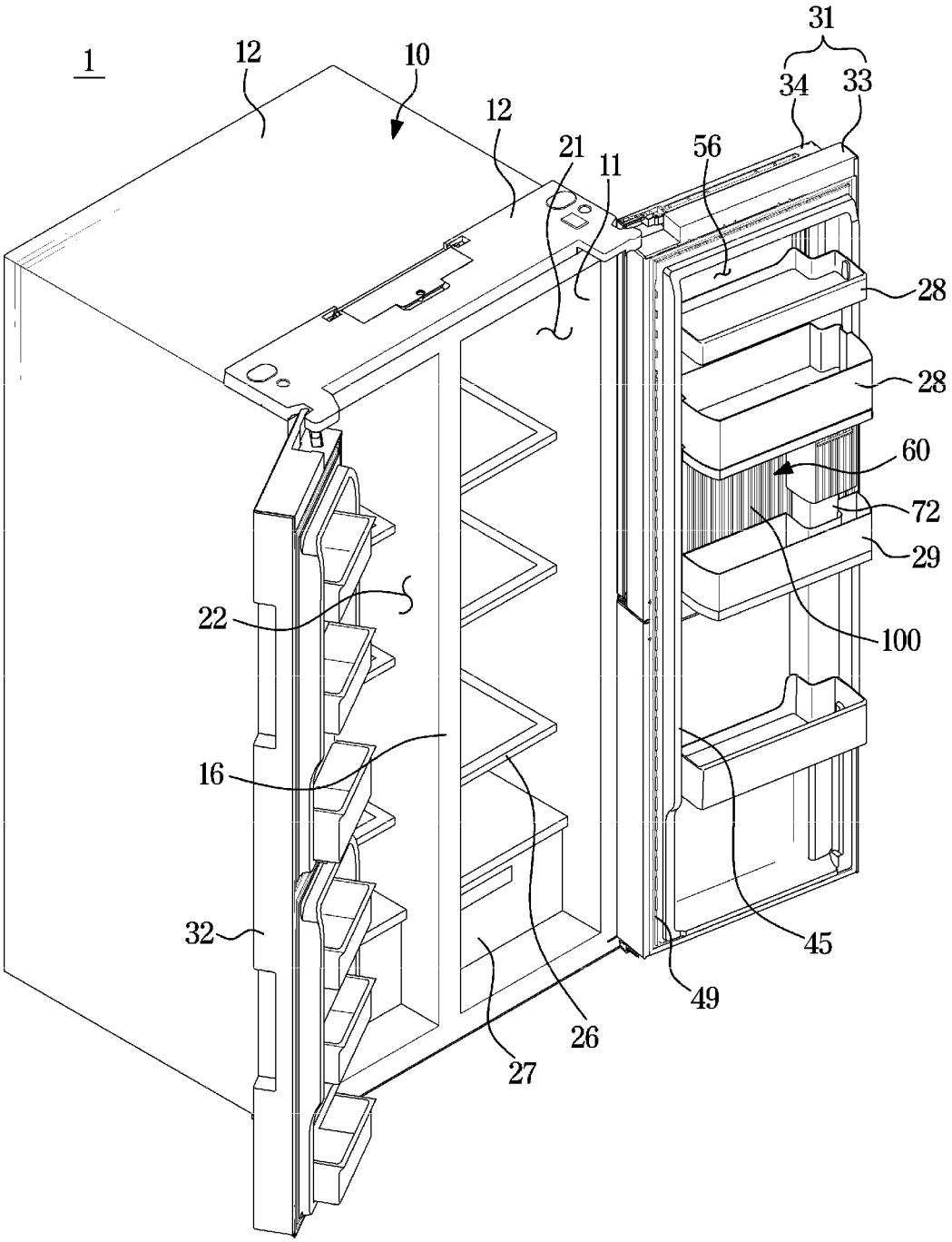
FIG. 3 is a perspective view showing a refrigerator according to an embodiment of the disclosure upon opening of an inner door.
Figure 4:
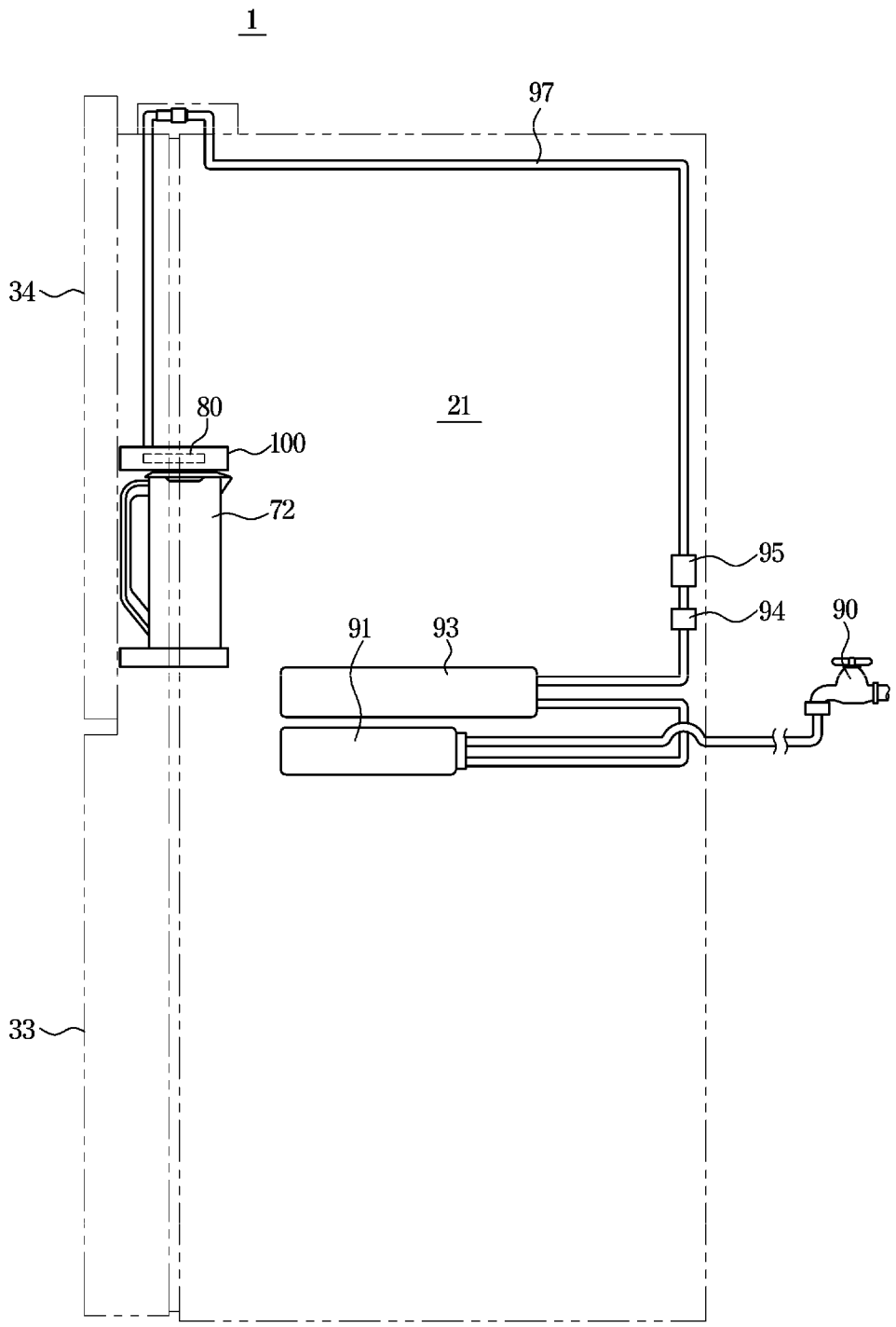
FIG. 4 schematically shows a water supply structure of a refrigerator according to an embodiment of the disclosure.
Figure 5:
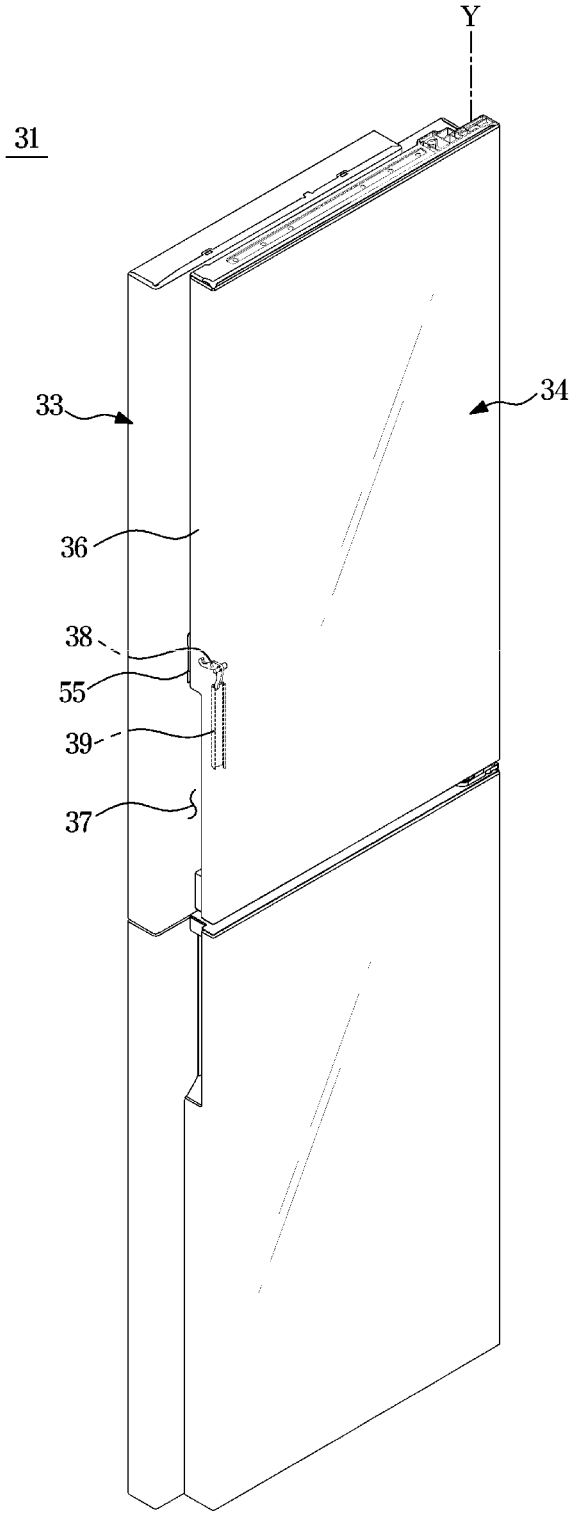
FIG. 5 shows an outer door and an inner door of a refrigerator according to an embodiment of the disclosure.

FIG. 1 is a perspective view showing an appearance of a refrigerator according to an embodiment of the disclosure. FIG. 2 is a perspective view showing a refrigerator according to an embodiment of the disclosure upon opening of an outer door. FIG. 3 is a perspective view showing a refrigerator according to an embodiment of the disclosure upon opening of an inner door. FIG. 4 schematically shows a water supply structure of a refrigerator according to an embodiment of the disclosure. FIG. 5 shows an outer door and an inner door of a refrigerator according to an embodiment of the disclosure.

Referring to FIGS. 1 to 5, a refrigerator 1 according to an embodiment of the disclosure may include a main body 10, a plurality of storage rooms 21 and 22 formed inside the main body 10, a plurality of doors 31 and 32 for opening or closing the storage rooms 21 and 22, and a cool air supply (not shown) for supplying cool air to the storage rooms 21 and 22.

The main body 10 may include an inner case 11 forming the storage rooms 21 and 22, an outer case 12 coupled to an outer side of the inner case 11 and forming an appearance, and an insulation (not shown) provided between the inner case 11 and the outer case 12 to insulate the storage rooms 21 and 22.

The storage rooms 21 and 22 may be partitioned into a storage room 21 positioned in a right side and a storage room 22 positioned in a left side by a vertical partition wall 16. The storage room 21 may be used as a refrigerating room, and the storage room 22 may be used as a freezing room. However, unlike the current embodiment of the disclosure, the refrigerator 1 may be one door type having a storage room and a door.

Inside the storage rooms 21 and 22, a shelf 26 on which food is put and a storage container 27 for storing food may be provided.

The cool air supply may generate cool air by using a cooling circulation cycle of compressing, condensing, expanding, and evaporating a refrigerant, and supply the generated cool air to the storage rooms 21 and 22.

The storage rooms 21 and 22 may be opened and closed by the respective doors 31 and 32. In the doors 31 and 32, a plurality of door baskets 28 and 29 having door storage spaces for storing food may be provided.

At least any one of the doors 31 and 32 may be configured as a double door having an inner door 33 and an outer door 34. For example, the door 31 positioned in the right side to open or close the storage room 21 may include the inner door 33 and the outer door 34.

The inner door 33 may be rotatably coupled to the main body 10 through a hinge. The inner door 33 may be provided on a front side of the main body 10 in such a way as to be rotatable with respect to a rotation axis X (see FIG. 6). On a rear surface of the inner door 33, an inner door gasket 45 that is tightly pressed to the front side of the main body 10 upon closing of the inner door 33 to seal the storage room 21 may be provided.

The inner door 33 may have an opening 56 to expose the storage room 21 to outside of the inner door 33 upon closing of the inner door 33. The opening 56 may be formed in an area of the inner door 33 except for edge portions of the inner door 33. The opening 56 may be formed in an upper portion of the inner door 33. The opening 56 may extend between a front surface 41*a* and a rear surface 42*a* of the inner door 33 (see FIGS. 12 to 14). Accordingly, upon closing of the inner door 33, the opening 56 may communicate with the storage room 21.

The inner door 33 may include a dike 45 (see FIG. 7) protruding in a rear direction. The dike 45 may be formed along edges of the inner door 33. The door basket 28 may be installed on the dike 45. The door basket 28 may be installed on the dike 45 such that at least one portion of the door basket 28 is positioned in the opening 56.

A water supply unit 60 may be installed on the dike 45. The water supply unit 60 may be installed on the dike 45 such that at least one portion of the water supply unit 60 is positioned in the opening 56.

The water supply unit 60 may include a water supply case 100, a dispenser 61, an automatic water supply 71, and a control valve 80 (see FIGS. 6 to 9).

The dispenser 61 may include a dispenser nozzle 66, and an operation lever 64 that is manually controllable to supply water through the dispenser nozzle 66 (see FIGS. 6 to 9). A user may press the operation lever 64 with a container (not shown) such as a cup.

The water supply case 100 may be installed on the dike 45. A water bucket 72 may be detachably installed in the water supply case 100. The water bucket 72 installed in the water supply case 100 may be cooled by cool air of the storage room 21.

The automatic water supply 71 may include an outlet 83 (see FIG. 10) for supplying water to the water bucket 72 installed in the water supply case 100, and a water level sensor 75 (see FIG. 8) for detecting a water level of the water bucket 72 installed in the water supply case 100. The automatic water supply 71 may automatically supply water to the water bucket 72 until the water bucket 72 is filled with a preset level of water.

The control valve 80 may guide water supplied from a water source 90 to the dispenser 61 and the automatic water supply 71. More specifically, the control valve 80 may guide water supplied from the water source 90 to the dispenser nozzle 66 and the outlet 83. The control valve 80 may be provided in the inner door 33.

As shown in FIG. 4, the refrigerator 1 may include a water purifying filter 91 and a water tank 93. The water purifying filter 91 may purify water supplied from the water source 90.

The water tank 93 may store water purified through the water purifying filter 91. The water tank 93 may be cooled by cool air of the storage room 21.

The refrigerator 1 may include a water supply flow path 97 for connecting the water source 90 with the control valve 80 to supply water to the dispenser 61 and the automatic water supply 71. The water supply flow path 97 may pass through the water purifying filter 91. Accordingly, water from the water source 90 may be purified by passing through the water purifying filter 81 and then supplied to the control valve 80. The water supply flow path 97 may pass through the water tank 93. Accordingly, water from the water source 90 may be cooled in the water tank 93 and then supplied to the control valve 80.

In the water supply flow path 97, a water valve 94 may be provided. The water valve 94 may adjust an amount of water that is supplied from the water tank 93 to the control valve 80. In the water supply flow path 97, a flow sensor 95 may be provided to measure an amount of water that is supplied to the control valve 80.

In the inner door 33, a through hole 53 (see FIG. 6) through which a cable and hose connected with the water supply unit 60 pass may be formed. The water supply flow path 97 inserted into the inner door 33 by passing through a hinge hole 52 (see FIG. 6) of the inner door 33 may be guided to the water supply case 100 through the through hole 53. The water supply flow path 97 may include a water supply hose 84 (see FIG. 9).

The outer door 34 may open or close the opening 56 of the inner door 33. Upon opening of the outer door 34, an access to the opening 56 of the inner door 33 may be allowed. The outer door 34 may be rotatably provided on a front side of at least one portion of the inner door 33. In the current embodiment of the disclosure, because the opening 56 of the inner door 33 is formed in the upper portion of the inner door 33, the outer door 34 may be rotatably provided on a front side of the upper portion of the inner door 33. The outer door 34 may be rotatably provided on the inner door 33 through a hinge 40*a*.

The outer door 34 may be rotatable with respect to a rotation axis Y. The rotation axis Y of the outer door 34 may be parallel to the rotation axis X of the inner door 33 (see FIG. 6). In the current embodiment of the disclosure, the rotation axis Y of the outer door 34 is shown to be spaced from the rotation axis X of the inner door 33. However, unlike the current embodiment of the disclosure, the rotation axis Y of the outer door 34 and the rotation axis X of the inner door 33 may be formed on the same line.

The rotation axis Y of the outer door 34 and the rotation axis X of the inner door 33 may extend in the same direction. That is, the rotation axis Y of the outer door 34 and the rotation axis X of the inner door 33 may extend along a right side of the main body 10.

The outer door 34 may include a first side surface 35 (see FIG. 12) positioned in the rotation axis (Y) side, and a second side surface 36 positioned in an opposite side of the rotation axis Y. In the second side surface 36, a handle 37 may be formed by being depressed. The handle 37 may extend in an up-down direction along the second side surface 36. A user may grab the handle 37 to open the outer door 34 while the inner door 33 is in a closed state or to open the outer door 34 and the inner door 33 together.

For this, a catch 55 may be provided in the front surface of the inner door 33, and a latch 38 and a switching lever 39 may be provided in the outer door 34.

The latch 38 may be movable between a locking position at which the latch 38 is connected with the catch 55, and a unlock position at which the latch 38 is separated from the catch 55, and the switching lever 39 may be controllable by a hand to change a position of the latch 38. For example, upon pressing of the switching lever 39, the latch 38 may move to the unlock position, and while the switching lever 39 is not pressed, the latch 39 may move to the locking position. An elastic member (not shown) for elastically supporting the latch 38 to the locking position may be provided.

To press the switching lever 39 while grabbing the handle 37, the switching lever 39 may be provided in the handle 37. By pulling the handle 37 while pressing the switching lever 39, the outer door 34 may open while the inner door 33 is maintained in a closed state, and by pulling the handle 37 without pressing the switching lever 39, the outer door 34 and the inner door 33 may open together.

On a rear surface of the outer door 34, an outer door gasket 40 may be provided to be, upon closing of the outer door 34, closely pressed to the front surface of the inner door 33 to seal the opening 56 of the inner door 33. The outer door gasket 40 may be provided along edges of the outer door 34.

Figure 12:
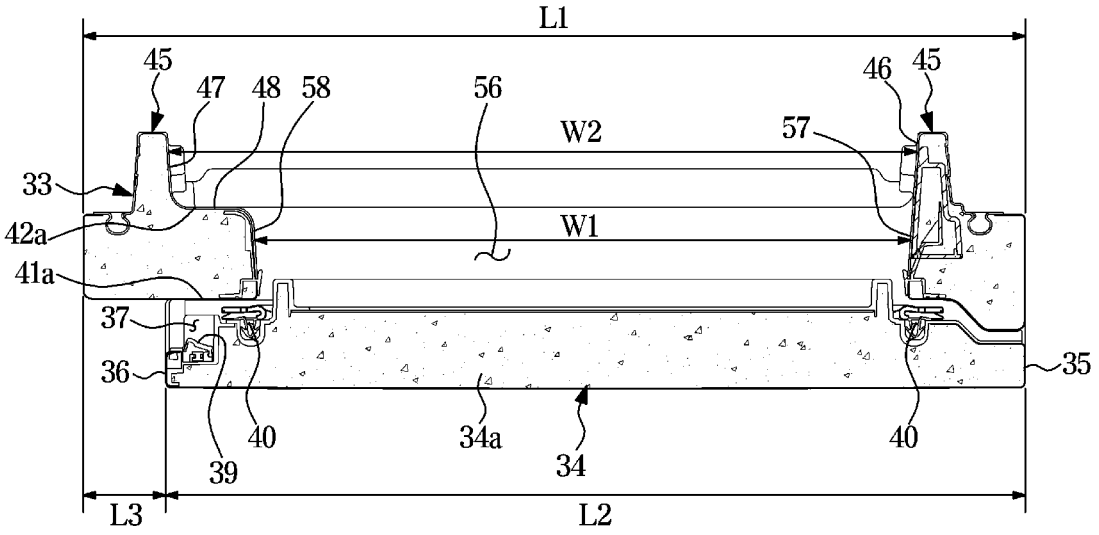
FIG. 12 is a cross-sectional view showing a state in which a water supply unit is separated from a door of a refrigerator according to an embodiment of the disclosure.

The latch 38 and the switching lever 39 may be positioned between the second side surface 36 of the outer door 34 and the outer door gasket 40 (see FIG. 12). The catch 55 may be provided on the front surface of the inner door 33 to correspond to a location of the latch 38. A decoration panel (not shown) may be detachably coupled to a front surface of the outer door 34.

To enable an access to the handle 37 of the outer door 34, a width L2 in left-right direction of the outer door 34 may be smaller than a width L1 in left-right direction of the inner door 33 (see FIG. 12). Accordingly, a user may put a hand into a space L3 corresponding to a difference between the width L1 in left-right direction of the inner door 33 and the width L2 in left-right direction of the outer door 34 to access the handle 37.

A top cover 24 may be coupled to an upper surface of the main body 10. The top cover 24 may cover hinges and various electronic parts positioned on the upper surface of the main body 10.

Figure 6:
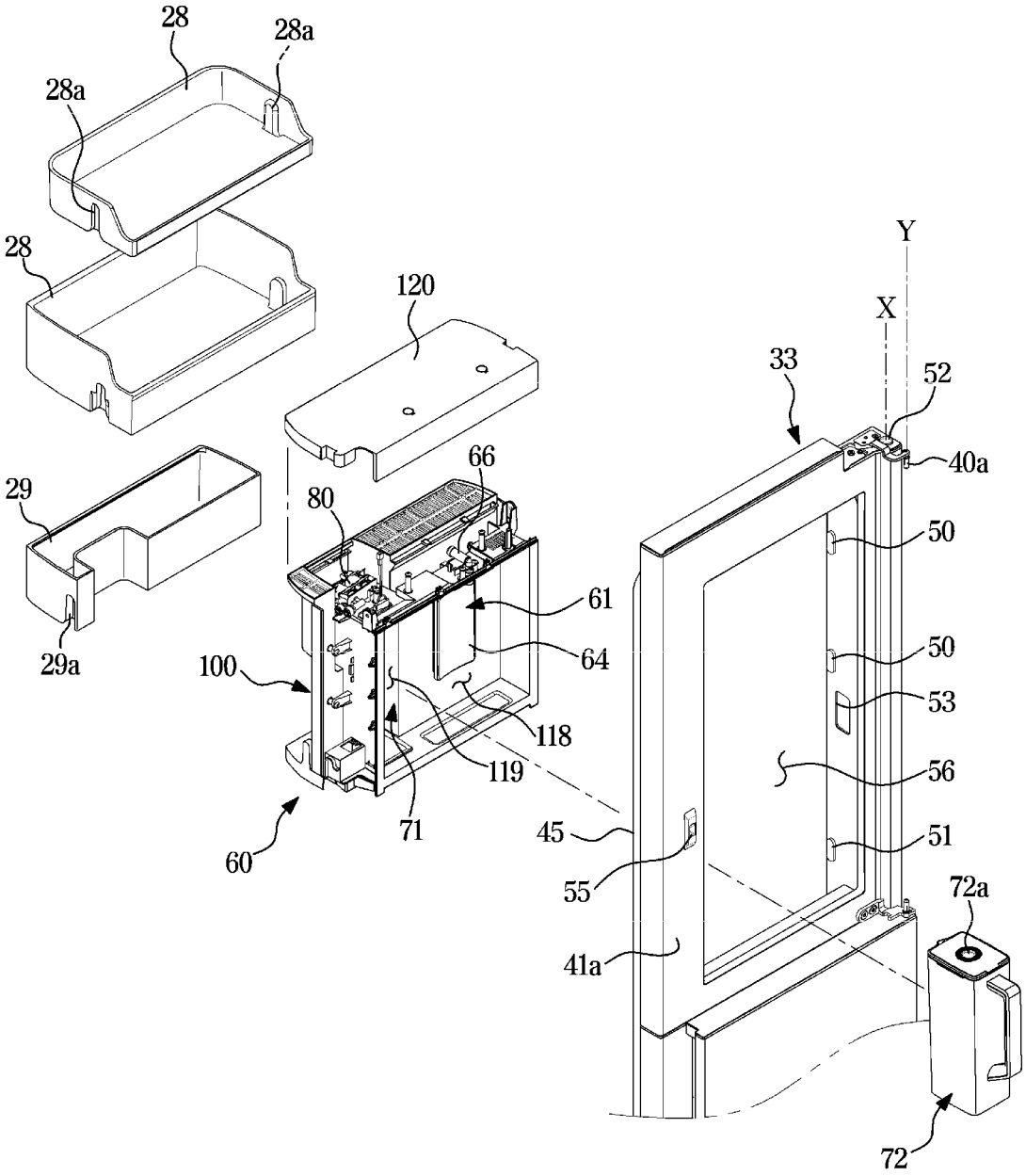
FIG. 6 is an exploded view showing an inner door, a water supply unit, and a door basket of a refrigerator according to an embodiment of the disclosure.
Figure 7:
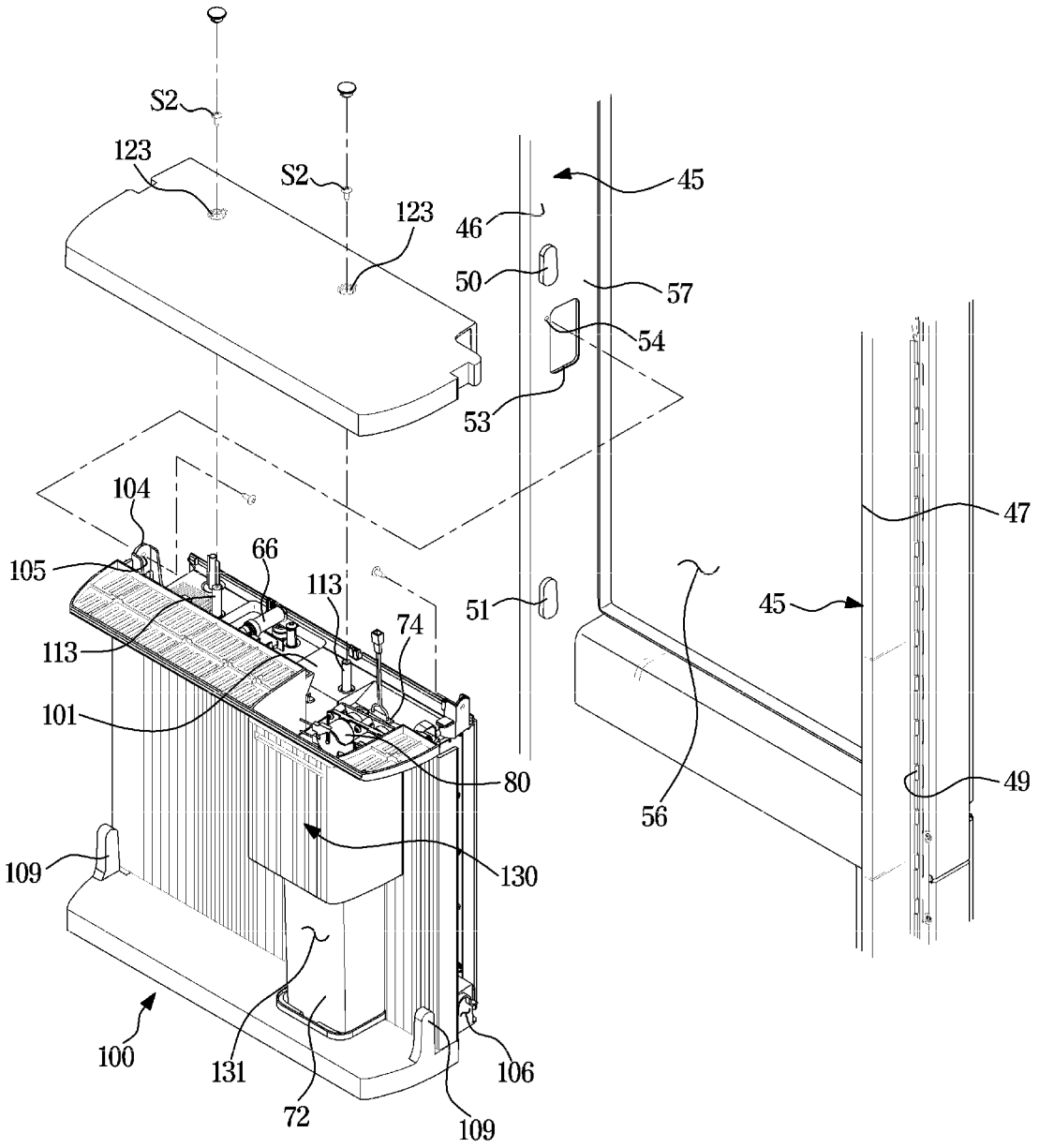
FIG. 7 is a perspective view showing a coupling structure of an inner door and a water supply unit of a refrigerator according to an embodiment of the disclosure.
Figure 8:
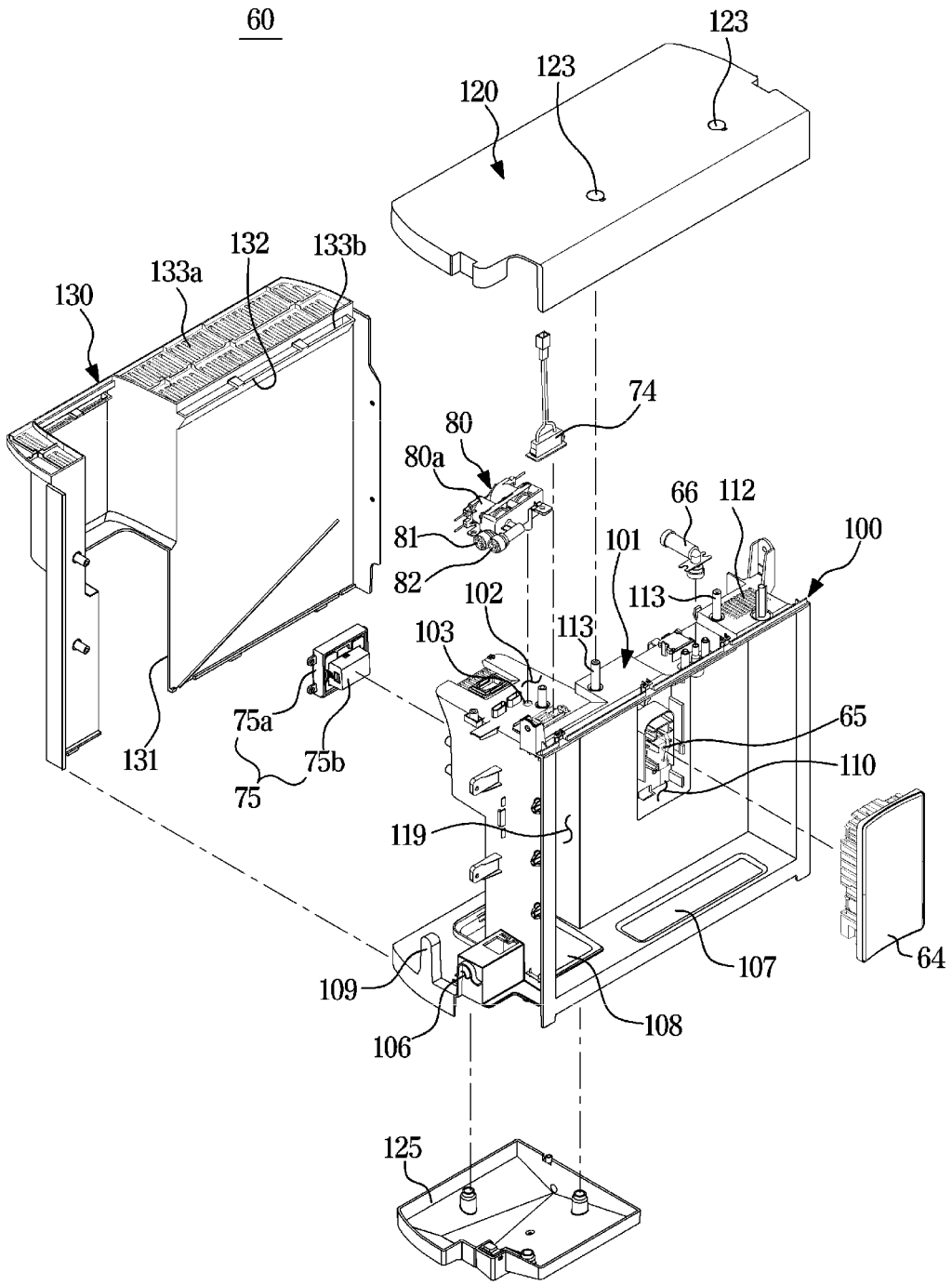
FIG. 8 is an exploded view showing a water supply unit of a refrigerator according to an embodiment of the disclosure.
Figure 9:
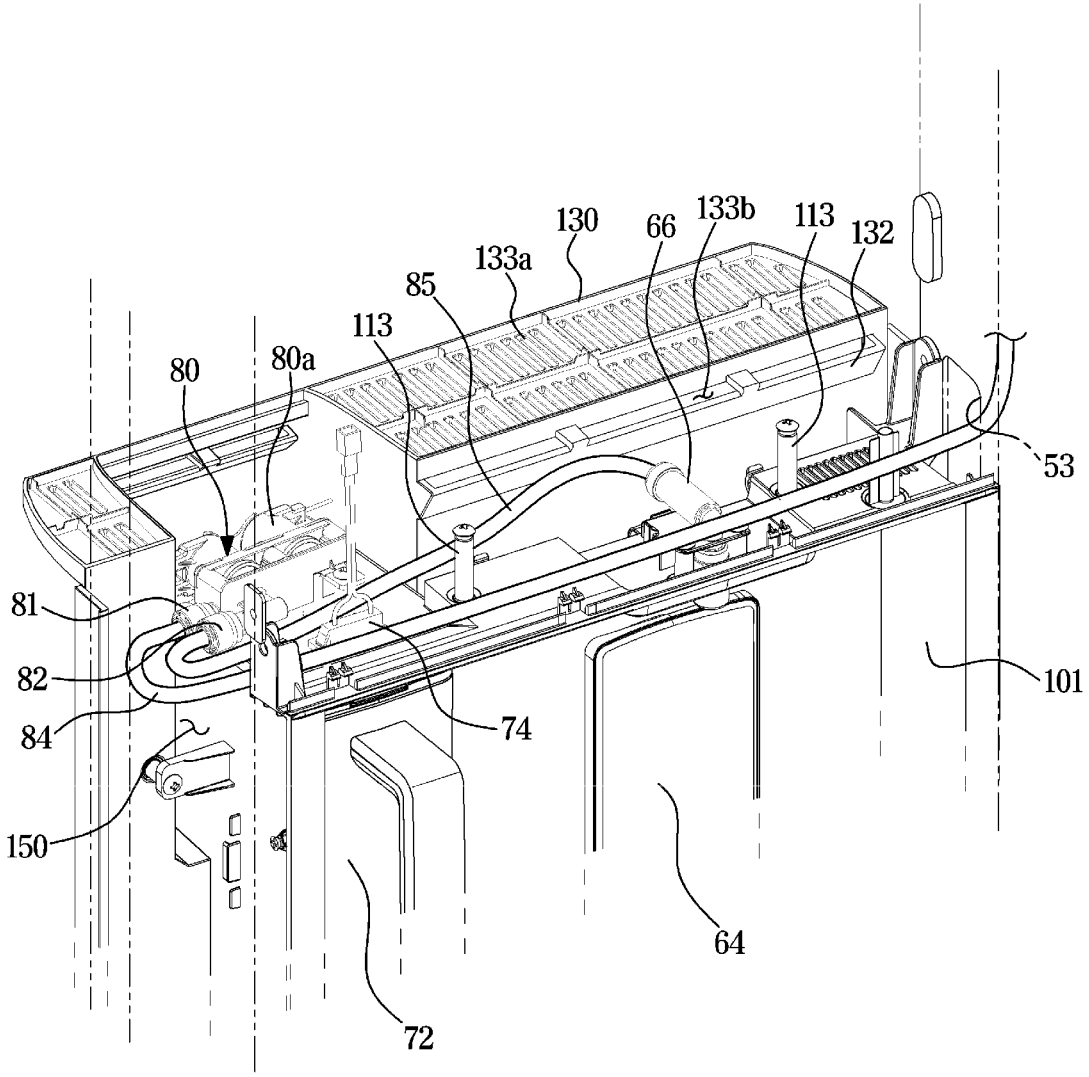
FIG. 9 shows a flow path structure in a water supply unit of a refrigerator according to an embodiment of the disclosure.
Figure 10:
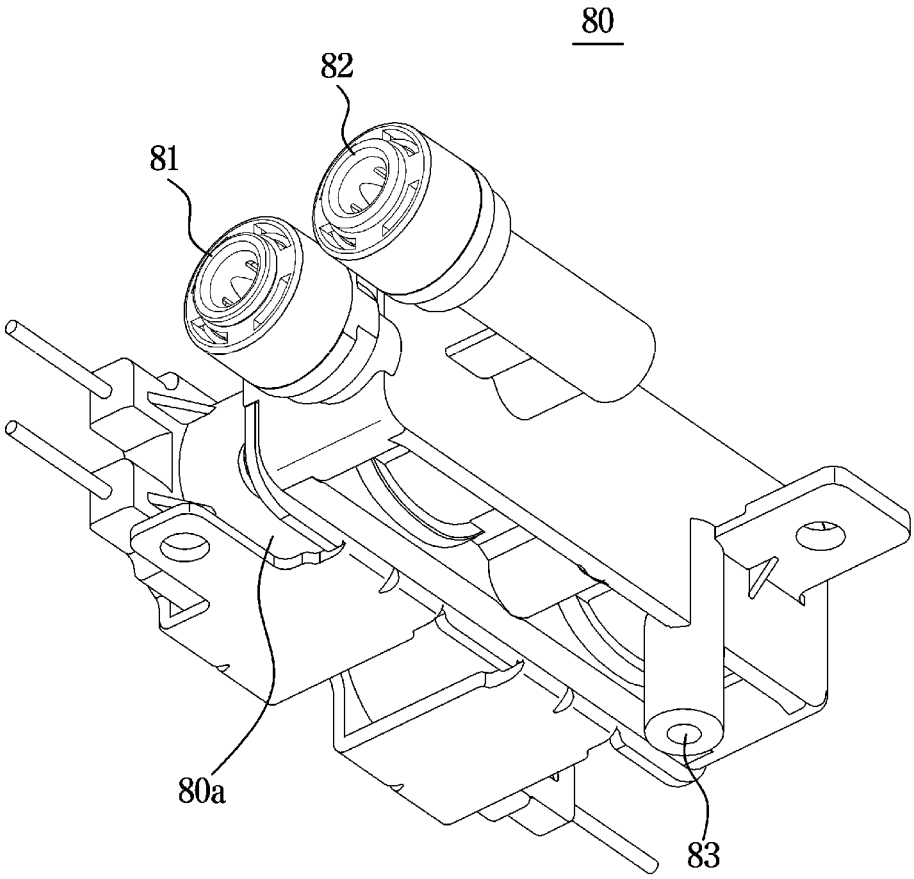
FIG. 10 shows a control valve of a refrigerator according to an embodiment of the disclosure.
Figure 11:
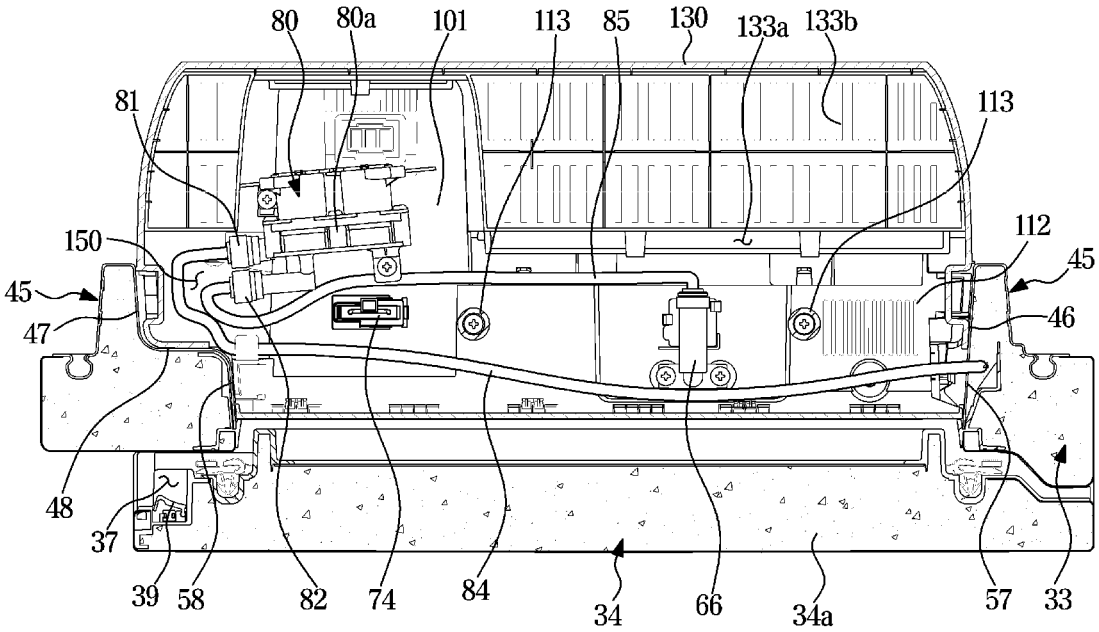
FIG. 11 is a cross-sectional view showing a state in which a water supply unit is installed in a door of a refrigerator according to an embodiment of the disclosure.
Figure 13:
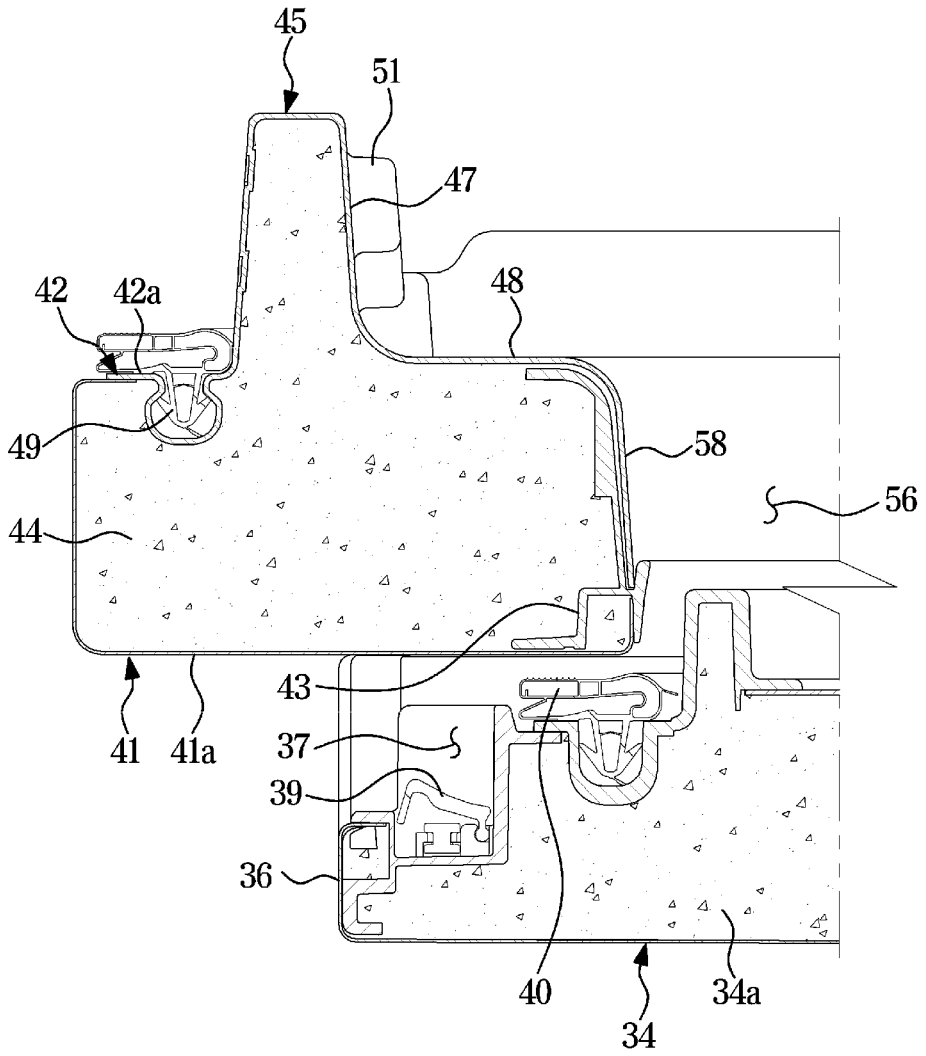
FIG. 13 is an enlarged cross-sectional view showing an opposite side of a rotation axis of a door in a refrigerator according to an embodiment of the disclosure.
Figure 14:
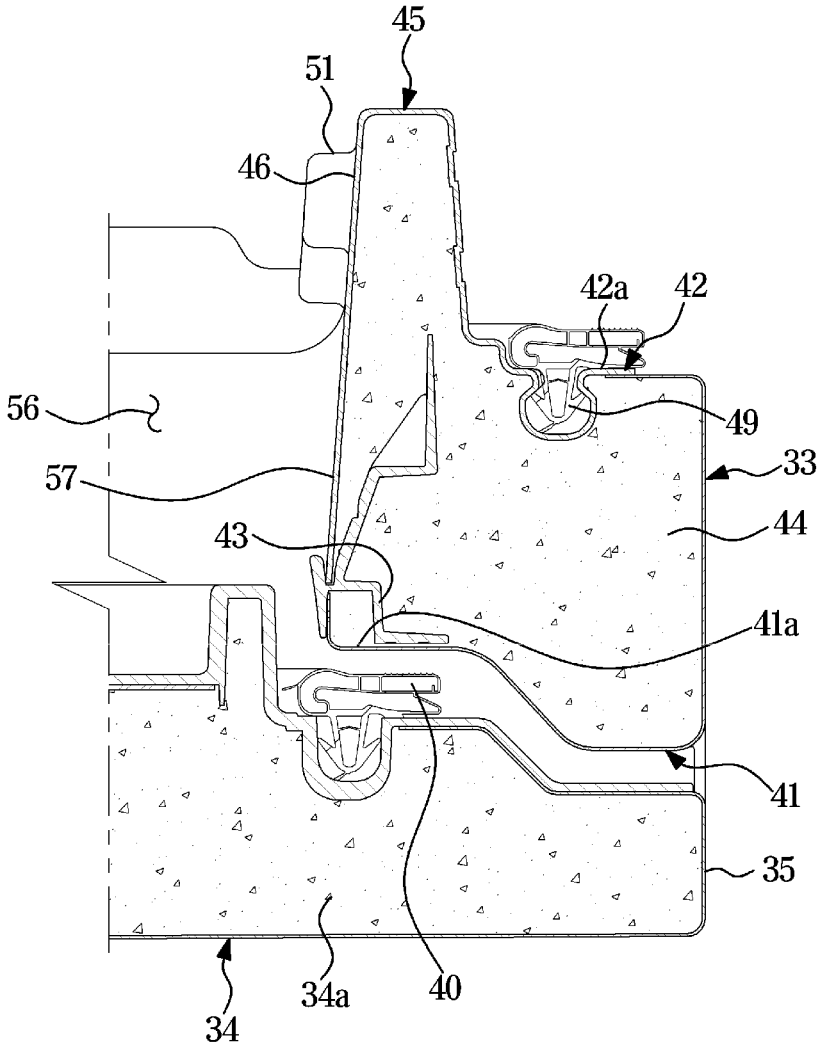
FIG. 14 is an enlarged cross-sectional view showing a rotation axis side of a door in a refrigerator according to an embodiment of the disclosure.

FIG. 6 is an exploded view showing an inner door, a water supply unit, and a door basket of a refrigerator according to an embodiment of the disclosure. FIG. 7 is a perspective view showing a coupling structure of an inner door and a water supply unit of a refrigerator according to an embodiment of the disclosure. FIG. 8 is an exploded view of a water supply unit of a refrigerator according to an embodiment of the disclosure. FIG. 9 shows a flow path structure in a water supply unit of a refrigerator according to an embodiment of the disclosure. FIG. 10 shows a control valve of a refrigerator according to an embodiment of the disclosure. FIG. 11 is a cross-sectional view showing a state in which a water supply unit is installed in a door of a refrigerator according to an embodiment of the disclosure. FIG. 12 is a cross-sectional view showing a state in which a water supply unit is separated from a door of a refrigerator according to an embodiment of the disclosure. FIG. 13 is an enlarged cross-sectional view showing an opposite side of a rotation axis of a door in a refrigerator according to an embodiment of the disclosure. FIG. 14 is an enlarged cross-sectional view showing a rotation axis side of a door in a refrigerator according to an embodiment of the disclosure.

Referring to FIGS. 6 to 14, the inner door 33 may include a front portion 41 forming a front surface 41*a* of the inner door 33, and a rear portion 42 forming a rear surface 42*a* of the inner door 33 (see FIGS. 13 and 14).

The inner door 33 may include the opening 56. The opening 56 may be formed between the front surface 41*a* and the rear surface 42*a* of the inner door 33 such that front and rear sides open. The inner door 33 may include a plurality of opening side surfaces 57 and 58 that define the opening 56.

The opening side surfaces 57 and 58 may include a first opening side surface 57 positioned in the rotation axis (X) side, and a second opening side surface 58 being opposite to the first opening side surface 57.

The inner door 33 may include the dike 45 protruding from the rear surface 42*a* of the inner door 33. The dike 45 may include a plurality of dike inner surfaces 46 and 47. The dike inner surfaces 46 and 47 may include a first dike inner surface 46 positioned in the rotation axis (X) side and extending onto a substantially same plane as the first opening side surface 57, and a second dike inner surface 47 being opposite to the first dike inner surface 46 and spaced from the second opening side surface 58.

A width W2 between the first dike inner surface 46 and the second dike inner surface 47 may be greater than a width W1 in left-right direction of the opening 56.

The rear surface 42*a* of the inner door 33 may include a spacing portion 48 (see FIGS. 11, 12, and 14) formed between the second dike inner surface 47 and the second opening side surface 58 to connect the second dike inner surface 47 with the second opening side surface 58.

The water supply unit 60 may be installed on the dike 45 such that at least one portion of the water supply unit 60 is positioned behind the spacing portion 48.

The inner door 33 may further include a door trim 43 for coupling the front surface 41 to the rear surface 42.

The dispenser 61 may include the dispenser nozzle 66, and the operation lever 64 that is manually controllable to supply water through the dispenser nozzle 66. The operation lever 64 may be installed in a lever installing portion 110 formed in the water supply case 100. The dispenser nozzle 66 may be installed in the water supply case 100. More specifically, the dispenser nozzle 66 may be installed in a main case 101.

The dispenser 61 may further include a switch 65 that is turned on by the operation lever 64 being pressed.

On a front surface of the water supply case 100, a water intake space 118 may be formed, wherein a container for receiving water discharged from the dispenser nozzle 66 may be put in the water intake space 118. The water intake space 118 may be formed by being depressed from the front surface of the water supply case 100.

The automatic water supply 71 may include the outlet 83 for supplying water to the water bucket 72 installed in the water supply case 100, and the water level sensor 75 for detecting a water level of the water bucket 72 installed in the water supply case 100.

The automatic water supply 71 may automatically supply water to the water bucket 72 until the water bucket 72 is filled with a preset level of water. That is, the automatic water supply 71 may perform an auto-fill function. However, the automatic water supply 71 may be controlled to supply a preset amount of water to the water bucket 72 regardless of a water level of the water bucket 71, instead of being controlled to supply water to the water bucket 72 until the water bucket 72 is filled with the preset level of water.

The outlet 83 (see FIG. 10) may be integrated into a second outlet port of the control valve 80. However, the outlet 83 may be implemented as a separate component, not the second outlet port of the control valve 80. In this case, the outlet 83 may be connected with the second outlet port through a separate flow path.

The control valve 80 may prevent water from being supplied to the water bucket 72 according to a detection by the water level sensor 75 that a water level of the water bucket 72 reaches the preset water level. That is, the control valve 80 may open or close the outlet 83, according to a water level of the water bucket 72, detected by the water level sensor 75.

The water level sensor 75 may be installed in the water supply case 100. More specifically, the water level sensor 75 may be coupled to a rear surface of the main case 101. However, a location of the water level sensor 75 is not limited to the rear surface of the main case 101, and the water level sensor 75 may be positioned at any location capable of detecting a water level of the water bucket 72.

The water level sensor 75 may be a capacitive sensor capable of detecting a water level of the water bucket 72 by detecting capacitance that changes according to a water level of a liquid stored in the water bucket 72. Because the water level sensor 75 is capable of detecting a water level of the water bucket 72 without directly contacting a liquid stored in the water bucket 72, the water level sensor 75 may have a relatively simple structure, and obtain a relatively accurate detection result.

The water level senor 75 may detect a water level of the water bucket 72 by contacting the water bucket 72. For this, the water level sensor 75 may include a sensor bracket 75*a* fixed to the main case 101, a sensor 75*b* for detecting a water level of the water bucket 72, and an elastic member for pressing the sensor 75*b* toward the water bucket 72.

Upon installing of the water bucket 72 in a water bucket installing space 119, the sensor 75*b* may contact the water bucket 72. The sensor 75*b* may be movable in a front-rear direction with respect to the sensor bracket 75*a*.

The automatic water supply 71 may include a water bucket sensor 74 for detecting whether the water bucket 72 has been installed in the water bucket installing space 119. The water bucket sensor 74 may be installed in the water supply case 100. More specifically, the water bucket sensor 74 may be provided in a valve installing space 102 provided in an upper portion of the main case 101. The water bucket sensor 74 may be configured as a hall sensor. The water bucket sensor 74 may detect a magnet (not shown) included in the water bucket 72. The water bucket sensor 74 may be provided at a location corresponding to the magnet upon installing of the water bucket 72 in the water bucket installing space 119. The water bucket sensor 74 may be covered by a case cover 120 not to be exposed to outside.

According to a detection by the water bucket sensor 74 that the water bucket 72 has not been installed in the water bucket installing space 119, the control valve 80 may prevent water from being supplied to the water bucket 72.

The automatic water supply 71 and the dispenser 61 may be positioned in the left-right direction with respect to each other.

The water supply case 100 may include the main case 101, a rear case 130 coupled to a rear portion of the main case 101, the case cover 120 coupled to an upper portion of the main case 101, and a tray 125 coupled to a lower portion of the main case 101.

On a front surface of the main case 101, the water intake space 118 and the water bucket installing space 119 may be formed. Accordingly, in a state in which the outer door 34 opens and the inner door 33 is closed, an access to the water intake space 118 and the water bucket installing space 119 may be allowed. The water intake space 118 and the water bucket installing space 119 may be positioned in the left-right direction with respect to each other.

In the lower portion of the main case 101, a container support 107 that supports a container for receiving water discharged to the water intake space 118, and a water bucket support 108 that supports the water bucket 72 for receiving water discharged through the automatic water supply 71 may be formed.

The main case 101 may include the lever installing portion 110 in which the operation lever 64 of the dispenser 61 is installed, and in the lever installing portion 110, a switch 65 that is turned on or off according to a location of the operating lever 64 may be provided.

In the upper portion of the main case 101, the valve installing space 102 may be formed. In the valve installing space 102, the control valve 80 may be installed, and the control valve 80 may be not exposed to the outside by the case cover 120 coupled to the upper portion of the main case 101. That is, the valve installing space 102 may be formed between the main case 101 and the case cover 120.

The case cover 120 may be coupled to the upper portion of the main case 101 through a coupling member such as a screw. For this, a coupling hole 123 to which a coupling member S2 is coupled may be formed in the case cover 120, and a coupling boss 113 to which the coupling member S2 is coupled may be formed in the main case 101.

Figure 15:
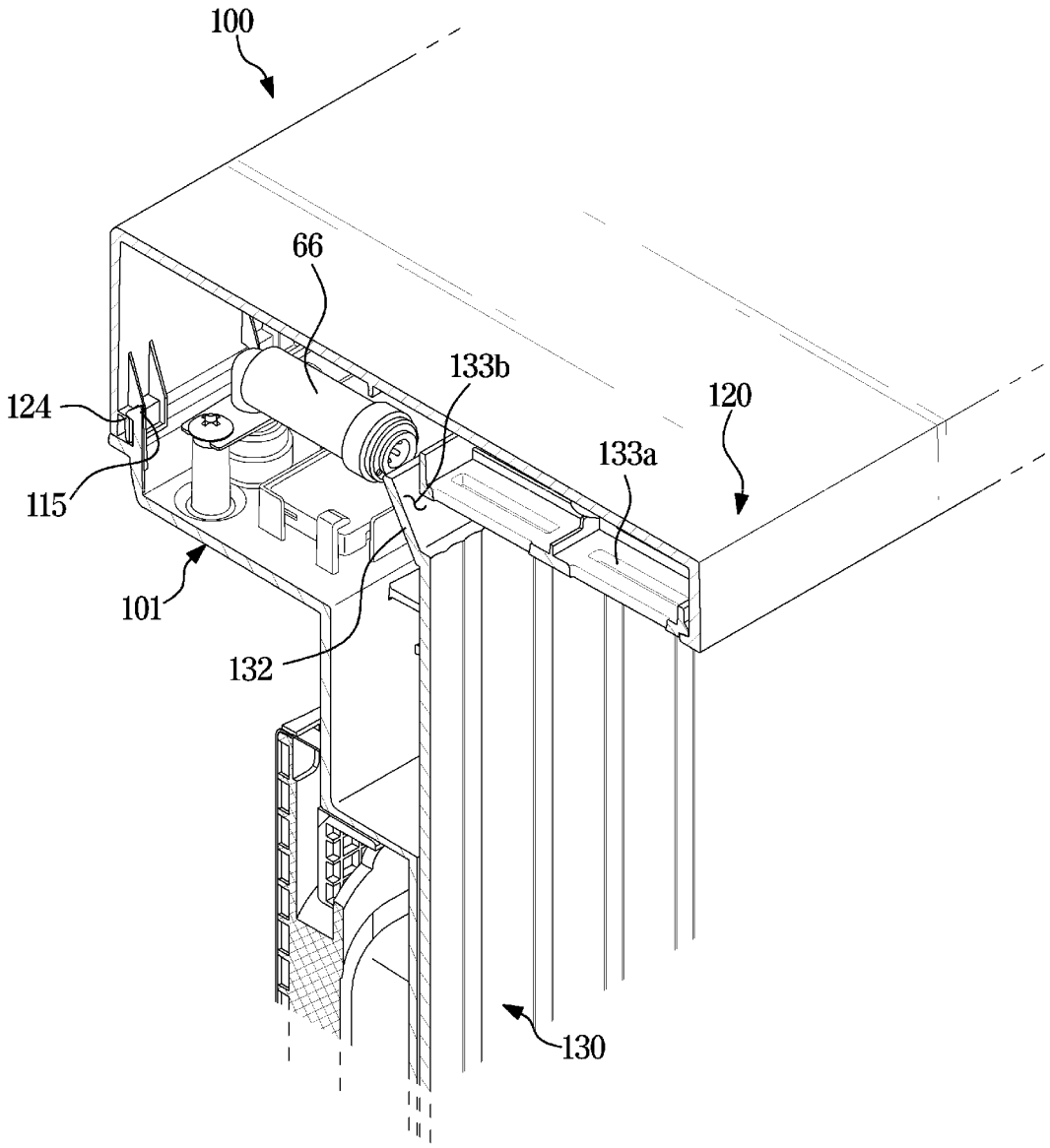
FIG. 15 is a cross-sectional view showing a water supply unit of a refrigerator according to an embodiment of the disclosure.

The main case 101 may include an elastic hook 115 coupled to a catching rib 124 of the case cover 120 to press the case cover 120 toward the main case 101 by elasticity (see FIG. 15). Because the case cover 120 is closely pressed to the main case 101 by elasticity of the elastic hook 115, no gap between the case cover 120 and the main case 101 may be formed.

The rear case 130 may form a rear appearance of the water supply unit 60. The rear case 130 may include a cut portion 131 formed by cutting a portion of the rear case 130 positioned behind the water bucket installing space 119. At least one side of the water bucket 72 installed in the water bucket installing space 119 may be exposed through the cut portion 131. Accordingly, the water bucket 72 may be stably cooled by cool air of the storage room 21.

The tray 125 may be provided below the main case 101. The tray 125 may store water discharged from the water bucket 72 installed in the water bucket installing space 119. That is, the tray 125 may collect water overflowing from the water bucket 72 due to an excessive supply of water to the water bucket 72.

The main case 101 may be installed on the dike 45 of the inner door 33. For this, a bead groove 106 may be formed in both side surfaces of the main case 101. By inserting a door bead 51 of the inner door 33 into the bead groove 106, the main case 101 may be installed on the dike 45 of the inner door 33. The door bead 51 may protrude from the dike inner surfaces 46 and 47.

The main case 101 may be firmly coupled to the inner door 33 through a coupling member such as a screw. For this, a coupling hole 105 to which a coupling member is coupled may be formed in the main case 101, and a coupling hole 54 to which a coupling member is coupled may be formed in the inner door 33. The main case 101 may include a coupling bracket 104 protruding upward, and the coupling hole 105 may be formed in the coupling bracket 104.

By the configuration, by inserting the door bead 51 of the inner door 33 into the bead groove 106 of the main case 101 and then coupling a coupling member to the coupling hole 105 of the main case 101 and the coupling hole 54 of the inner door 33, the main case 101 may be coupled to the inner door 33. In contrast, by separating the coupling member from the coupling hole 105 of the main case 101 and the coupling hole 54 of the inner door 33 and separating the door bead 51 from the bead groove 106, the main case 101 may be separated from the inner door 33.

The door baskets 28 and 29 may include a door basket 28 installed on the door bead 51 of the inner door 33, and a door basket 29 installed on a case bead 109 of the water supply case 100 (FIG. 7).

A bead groove 28*a* may be formed in both sides of the door basket 28, and by inserting the door bead 51 into the bead groove 28*a*, the door basket 28 may be installed on the inner door 33.

A bead groove 29*a* may be formed in both sides of the door basket 29, and by inserting the case bead 109 of the water supply case 100 into the bead groove 29*a*, the door basket 29 may be installed on the water supply case 100.

The control valve 80 may guide water supplied from the water source 90 through the water supply flow path 97 to the dispenser nozzle 66 of the dispenser 61 or the outlet 83 of the automatic water supply 71. The control valve 80 may be a three-way valve.

More specifically, the control valve 80 may include a valve body 80*a* forming a valve flow path therein, an inlet port 81 connected with the water supply hose 84 for receiving water from the water source 90, a first outlet port 82 connected with a dispensing hose 85 for supplying water to the dispenser nozzle 66, and a second outlet port for supplying water to the outlet 83. The outlet 83 and the second outlet port may be integrated into one body. The first outlet port 82 and the second outlet port may be selectively opened or closed.

The control valve 80 may open the first outlet port 82 that supplies water to the dispenser nozzle 66, according to a preset signal input to the operation lever 64.

Upon installing of the control valve 80 in the water supply case 100, the second outlet port may be positioned downward toward the water bucket 72, and the inlet port 81 and the first outlet port 82 may protrude in a side direction from the valve body. The second outlet port may be positioned at a valve passing hole 103 formed in an upper side of the main case 101. Water discharged from the second outlet port may fall in a direction of gravity and directly enter an inlet 72*a* of the water bucket 72 without a separate connecting member.

The water supply case 100 may include a buried space 150 (see FIGS. 9 and 11) positioned behind the spacing portion 48. The buried space 150 may be a space resulting from excluding the width W2 in the left-right direction of the opening 56 from the width W2 between the first dike inner surface 46 and the second dike inner surface 47, the space being located behind the inner door 33. Accordingly, because the buried space 150 is located inside the water supply case 100 without being exposed through the opening 56, the buried space 150 may be not used for storing food. The buried space 150 may be positioned behind the inner door 33 to correspond to the handle 37 of the outer door 37.

The inlet port 81 and the first outlet port 82 of the control valve 80 may be positioned toward the buried space.

As such, because the inlet port 81 and the first outlet port 82 are positioned toward the buried space 150, the water supply hose 84 and the dispensing hose 85 may be connected with the inlet port 81 and the first outlet port 82, respectively, by being gently bent in the buried space 150. Accordingly, a tension applied to the water supply hose 84 and the dispensing hose 85 may be reduced such that the water supply hose 84 and the dispensing hose 85 are firmly coupled to the inlet port 81 and the first outlet port 82, and water may flow smoothly inside the water supply hose 84 and the dispensing hose 85.

Also, because no additional space for connecting the water supply hose 84 and the dispensing hose 85 with the inlet port 81 and the first outlet port 82 is needed, a size of the water supply unit 60 may be reduced to increase space utilization of the storage room 21.

That is, in a case in which the inlet port 81 and the first outlet port 82 are not positioned toward the buried space 150, a size in front-rear direction or up-down direction of the water supply unit 60 may need to increase to enable the water supply hose 84 and the dispensing hose 85 to be gently bent and connected with the inlet port 81 and the first outlet port 82, resulting in a space reduction of the storage room 21.

For example, in a case in which the inlet port 81 and the first outlet port 82 are positioned in an opposite direction of the buried space 150, there may be difficulties in connecting the water supply hose 84 and the dispensing hose 85 with the inlet port 81 and the first outlet port 82 due to internal structures of the water supply unit 60, such as the water bucket sensor 74 and the coupling boss 113. Also, in a case in which the inlet port 81 and the first outlet port 82 are positioned toward a front, rear or upper direction of the inner door 33, a width in front-rear direction or up-down direction of the water supply unit 60 may increase to secure a space where the water supply hose 84 and the dispensing hose 85 are gently bent, resulting in a storage space reduction of the storage room 21.

FIG. 15 is a cross-sectional view showing a water supply unit of a refrigerator according to an embodiment of the disclosure.

Referring to FIG. 15, the water supply case 100 may include a cool air hole formed in the water supply case 100 to smoothly supply cool air of the storage room 21 to the water bucket installing space 119 and the water intake space 118 formed on the front surface of the water supply case 100.

The cool air hole may include a first cool air hole 112 (see FIG. 8) formed in the main case 101, and a second cool air hole 133*a* and a third cool air hole 133*b* formed in the rear case 130.

Cool air of the storage room 21 may enter an internal space between the case cover 120 and the main case 101 through the second cool air hole 133*a* and the third cool air hole 133*b*, and may be guided to the water intake space 118 and the water bucket installing space 119 through the first cool air hole 112.

Because cool air of the storage room 21 is smoothly supplied to the water bucket installing space 119 through the cool air hole, the water bucket 72 installed in the water bucket installing space 119 may be efficiently cooled.

In the rear case 130, a guide rib 132 may be formed in an inclined shape to smoothly supply cool air of the storage room 21 to inside of the water supply case 100 through the third cool air hole 133*b* while preventing water from entering the inside of the water supply case 100.

Figure 16:
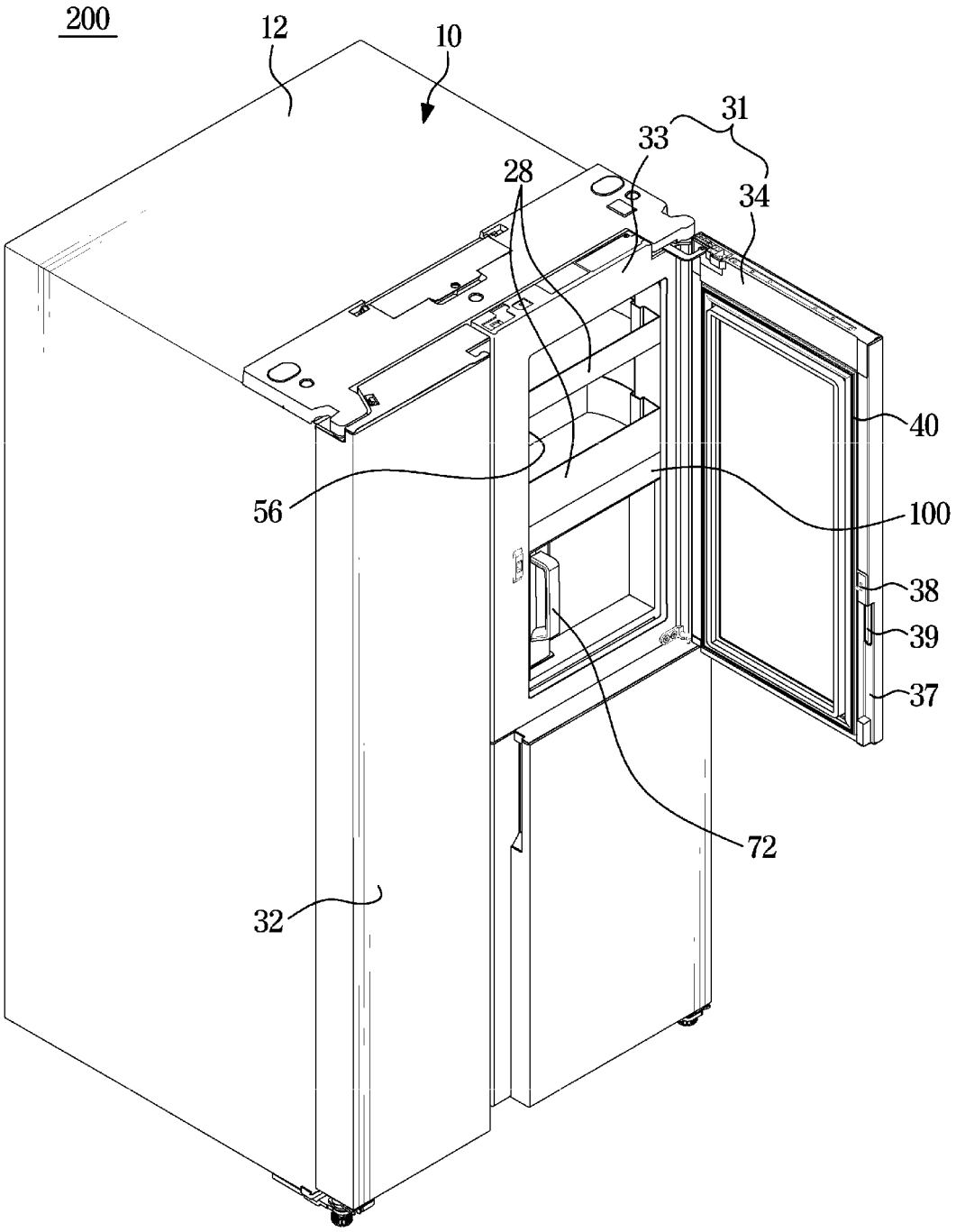
FIG. 16 shows a state in which an outer door of a refrigerator according to another embodiment of the disclosure opens.

FIG. 16 shows a state in which an outer door of a refrigerator according to another embodiment of the disclosure opens.

Hereinafter, the same components as those of the above-described embodiment of the disclosure will be assigned the same reference numerals as those assigned to the corresponding components of the embodiment of the disclosure, and descriptions thereof will be omitted.

As shown in FIG. 16, in the refrigerator 1 according to the above-described embodiment of the disclosure, the dispenser 61 may be omitted. In this case, the control valve 80 may be a two-way valve, not a three-way valve, and the first outlet port 82 may be omitted.

According to various embodiments of the disclosure, because the inner door does not need to open upon an access to the dispenser and the automatic water supply, energy loss may be reduced.

According to various embodiments of the disclosure, because the water bucket is moved in and out in the front direction from the inner door to install the water bucket in the automatic water supply or take the water bucket out of the automatic water supply, usability may be improved.

According to various embodiments of the disclosure, because the dispenser and the automatic water supply are integrated into an assembly, assembility, durability, and a design may be improved.

According to various embodiments of the disclosure, by reducing a width in front-rear direction of the water supply unit installed in the opening of the inner door, space utilization of the storage room may increase.

Although the technical concept of the disclosure has been described based on specific embodiments, the scope of rights of the disclosure is not limited to these embodiments. It should be interpreted that various embodiments modified or changed by a person skilled in the art within a scope not deviating from the gist of the disclosure as the technical concept of the disclosure, which is defined in the claims, also belong to the scope of rights of the disclosure.

What is claimed is:

1. A refrigerator comprising:

a main body including a storage room;

an inner door provided on a front side of the main body and configured to be rotatable about a rotation axis, the inner door including a front surface of the inner door, a rear surface of the inner door, an opening between the front surface of the inner door and the rear surface of the inner door, and a dike protruding from the rear surface of the inner door;

an outer door rotatably provided on a front side of at least one portion of the inner door and configured to open or close the opening; and a water supply unit including a water supply case, a water bucket configured to be detachably installed in the water supply case, an outlet configured to supply water to the water bucket when the water bucket is installed in the water supply case, and a water level sensor configured to detect a water level of the water bucket when the water bucket is installed in the water supply case, wherein the inner door includes opening side surfaces forming the opening, the opening side surfaces including a first opening side surface and a second opening side surface, opposite to the first opening side surface, the dike includes a first dike inner surface extending along a same plane as the first opening side surface, and a second dike inner surface that is opposite to the first dike inner surface and spaced from the second opening side surface, such that a dike width between the first dike inner surface and the second dike inner surface is greater than an opening width between the first opening side surface and the second opening side surface, the rear surface of the inner door includes a spacing portion formed between the second dike inner surface and the second opening side surface, and connecting the second dike inner surface with the second opening side surface, and the water supply unit is installed on the dike such that at least one portion of the water supply unit is positioned behind the spacing portion.

2. The refrigerator of claim 1, wherein the first opening side surface is closer to the rotation axis than the second opening side surface, the first dike inner surface is closer to the rotation axis than the second dike inner surface, and the outer door includes:

a first outer door side surface, a second outer door side surface, opposite to the first outer door side surface, the first outer door side surface being closer to the rotation axis than the second outer door side surface, and a handle extending inward from the second outer door side surface.

3. The refrigerator of claim 2, wherein a width of the outer door is smaller than a width of the inner door so as to provide access to the handle.

4. The refrigerator of claim 2, wherein the inner door includes a catch, and the outer door includes:

a latch configured to be movable between a locking position at which the latch is connected with the catch, and an unlock position at which the latch is separated from the catch, and a switching lever provided on the handle and configured to control movement of the latch between the locking position and the unlock position.

5. The refrigerator of claim 4, wherein the outer door includes:

an outer door gasket provided along an edge of the outer door on a rear surface of the outer door, and configured to seal the opening of the inner door upon closing of the outer door, and the latch is positioned between the second outer door side surface and the outer door gasket.

6. The refrigerator of claim 1, wherein the water supply unit further includes a control valve configured to supply the water to the outlet according to the water level of the water bucket when the water bucket is installed in the water supply case.

7. The refrigerator of claim 6, wherein the control valve includes:

a valve body, an inlet port protruding from the valve body and configured to be connected with a water supply hose that supplies water from a water source, and an outlet port protruding from the valve body and configured to supply the water to the outlet.

8. The refrigerator of claim 7, wherein the outlet port and the outlet are integrated into one body.

9. The refrigerator of claim 7, wherein the control valve is installed in the water supply case, the outlet port protrudes downward from the valve body toward the water bucket when the water bucket is installed in the water supply case, and the inlet port protrudes in a side direction from the valve body.

10. The refrigerator of claim 9, wherein the water supply case includes a buried space positioned behind the spacing portion, and the inlet port protrudes toward the buried space.

11. The refrigerator of claim 9, wherein the inner door includes a door bead protruding from at least one of the first dike inner surface and the second dike inner surface, and the water supply case includes a bead groove in which the door bead is insertable so as to mount the water supply case on the inner door.

12. The refrigerator of claim 9, wherein the inner door includes a coupling hole formed in at least one of the first opening side surface and the second opening side surface, the water supply case includes a through hole corresponding to the coupling hole, and the refrigerator further includes a coupling member configured to be inserted in the through hole and the coupling hole to secure the water supply case to the inner door.

13. The refrigerator of claim 6, wherein the water supply case includes:

a main case forming a water bucket installing space in which the water bucket is detachably installable on a front surface of the main case, and forming a valve installing space in which the control valve is installed, on an upper side of the main case; and a case cover coupled to an upper portion of the main case and configured to cover the valve installing space.

14. The refrigerator of claim 13, wherein the water supply unit further includes:

a dispenser nozzle, and an operation lever configured to be manually controllable to cause water to be supplied through the dispenser nozzle.

15. The refrigerator of claim 14, wherein a water intake space configured to supply the water through the dispenser nozzle is formed on the front surface of the main case, and the water intake space and the water bucket installing space are positioned side by side such that the water bucket installing space is positioned further from the rotation axis than the water intake space.

* * * * *